United States Patent [19]

Tengler et al.

[11] Patent Number: 4,762,508

[45] **Date of Patent: * Aug. 9, 1988**

[54] MODULAR ELECTRICAL CONNECTOR SYSTEM

[75] Inventors: John N. Tengler, Chardon; James C. Pilny, Painesville, both of Ohio

[73] Assignee: Minnesota Mining and Manufacturing Company, St. Paul, Minn.

[ * ] Notice: The portion of the term of this patent subsequent to Nov. 27, 2001 has been disclaimed.

[21] Appl. No.: 845,615

[22] Filed: Mar. 28, 1986

Related U.S. Application Data

[62] Division of Ser. No. 628,155, Jul. 5, 1984, Pat. No. 4,586,769, which is a division of Ser. No. 335,656, Dec. 30, 1981, Pat. No. 4,484,792.

[51] Int. Cl.[4] ..... H01R 13/502

[52] U.S. Cl. ..... 439/607; 439/712; 439/716

[58] Field of Search ..... 339/198 G, 198 GA, 198 H, 339/198 P, 218 R, 218 M, 217 S, 206 R, 136 M, 138, 143 R; 439/712–718, 603, 731, 607–610

[56] References Cited

U.S. PATENT DOCUMENTS

| | | | |
|---|---|---|---|
| 4,343,528 | 8/1982 | Lucius et al. | 339/198 G |
| 3,456,231 | 7/1969 | Paullus et al. | 339/198 GA |
| 3,471,822 | 10/1969 | Van Baelen | 339/198 G |
| 3,559,813 | 2/1971 | Sosinski | 339/198 GA |
| 3,594,696 | 7/1971 | Witek, Jr. | 339/218 R |
| 3,901,575 | 8/1975 | Hoover | 339/217 S |
| 4,148,543 | 4/1979 | Shores | 339/143 R |
| 4,484,792 | 11/1984 | Tengler et al. | 339/206 R |

FOREIGN PATENT DOCUMENTS

| | | | |
|---|---|---|---|
| 1232356 | 10/1960 | France | 339/198 G |

*Primary Examiner*—John McQuade

*Attorney, Agent, or Firm*—Renner, Otto, Boisselle & Sklar

[57] ABSTRACT

A modular electrical connector system provides relatively high density pin out capability for high speed signal transmission and coupling while maintaining discrete wire capability. The system includes plural cable terminators, plural connector blocks, each having plural cells to receive and hold respective terminators with the contacts thereof aligned for connection with further contacts inserted to engage the same, and a frame to hold the connector blocks securely in relative position to each other. Each cable terminator includes one or more contacts for electrically connecting with the cable conductor, electrical insulating molded about the junction of the contact and conductor, and a flexible locking mechanism to facilitate locking and removal of the terminator from its connector block cell, preferably from the back thereof, without disturbing other terminators in the connector block. Means are provided to probe the signals carried by respective terminators while positioned in the connector block, and for such probing and for the inserting/removing function special tools are provided. Methods also are disclosed for servicing such electrical connector systems to insert and/or to remove respective terminators without affecting others and for probing electrical signals carried via respective terminators.

12 Claims, 7 Drawing Sheets

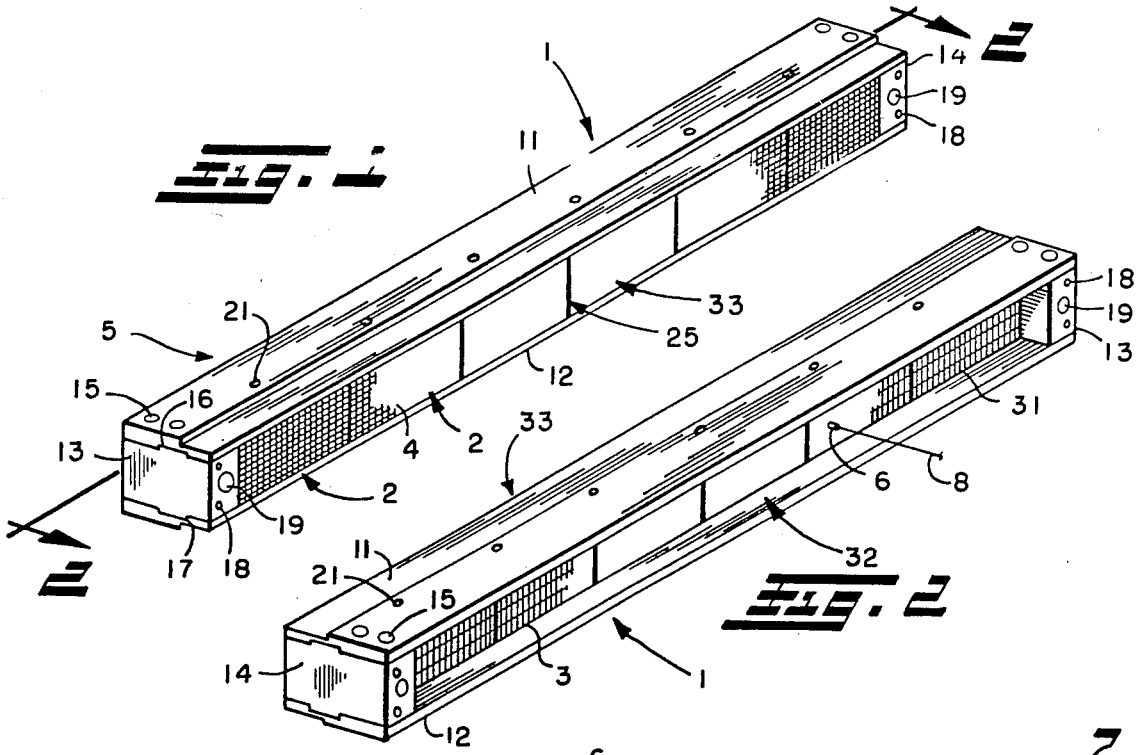
Fig. 1
Fig. 2
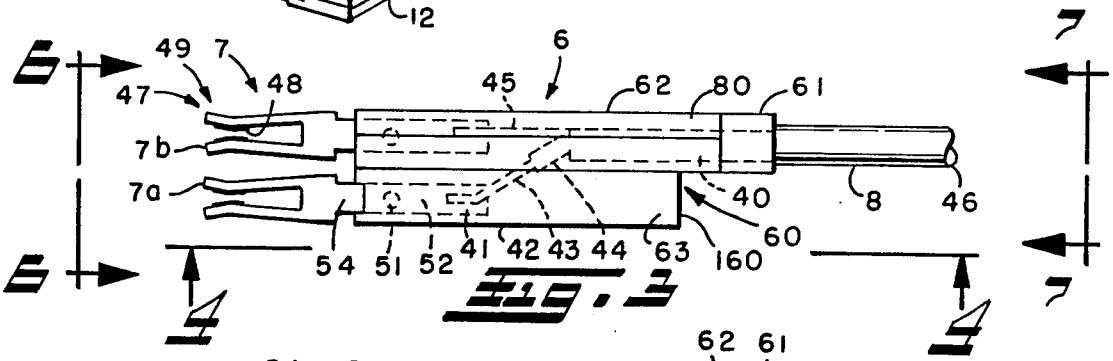
Fig. 3
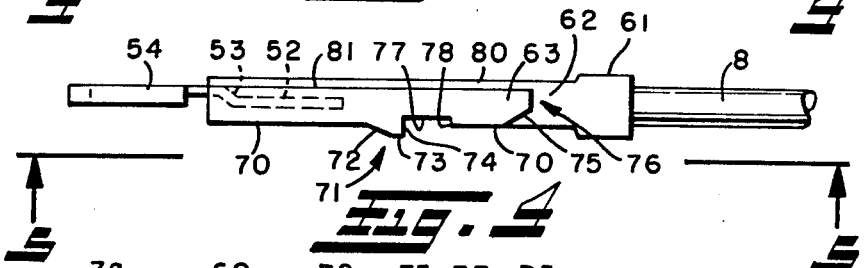
Fig. 4
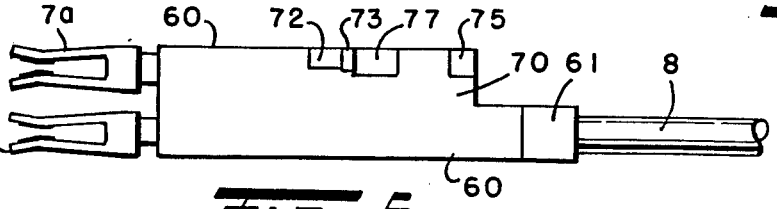
Fig. 5
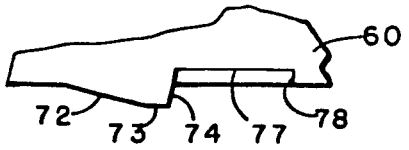
Fig. 8
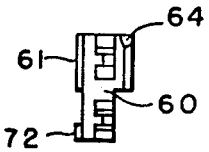
Fig. 6
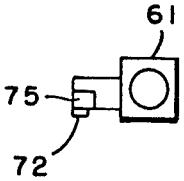
Fig. 7

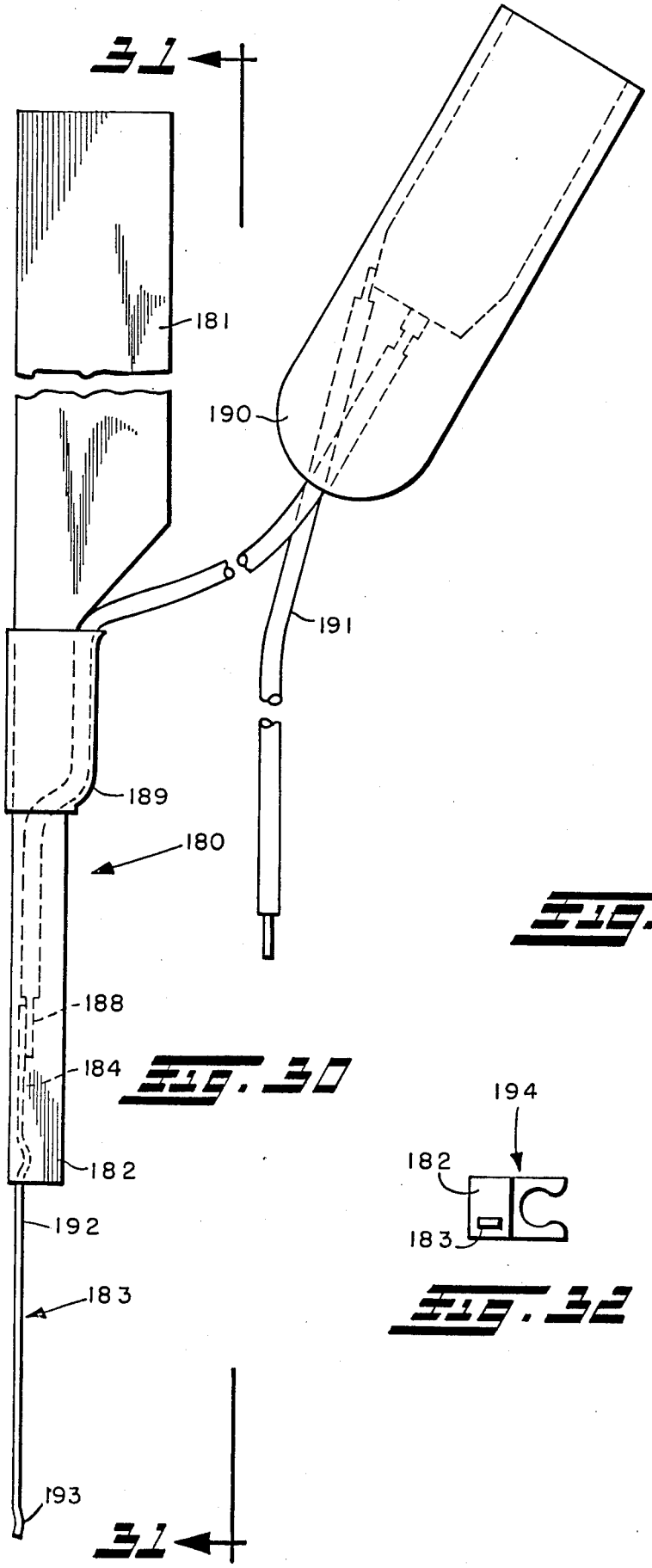
Fig. 30
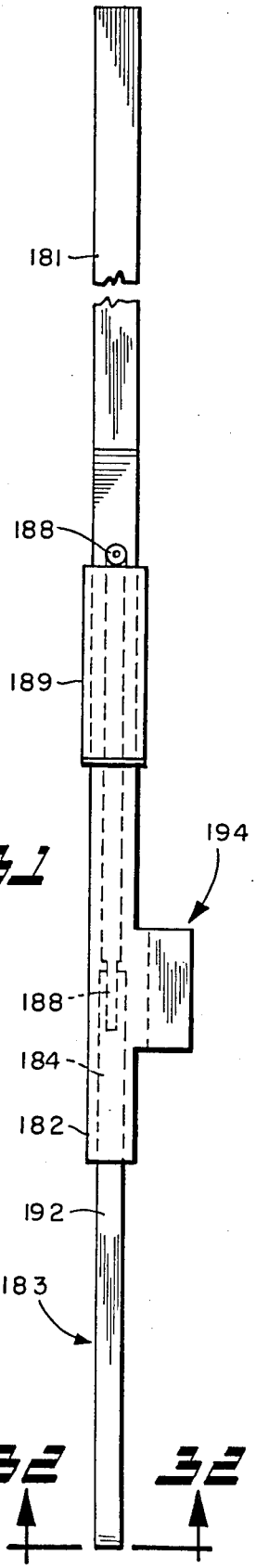
Fig. 31
Fig. 32

MODULAR ELECTRICAL CONNECTOR SYSTEM

This is a divisional of co-pending application Ser. No. 628,155 filed on July 5, 1984, now U.S. Pat. No. 4,586,769 which is a divisional of application Ser. No. 335,656 filed on Dec. 30, 1981, now U.S. Pat. No. 4,484,792.

TECHNICAL FIELD

The present invention relates to electrical connectors and, more particularly, to providing relatively high density multiple connections for high speed transmission systems. The invention also relates to methods for servicing such electrical connectors and for probing signals transmitted therein.

BACKGROUND OF PRIOR ART

In modern computers the transmission of relatively high speed signals is common. To maintain the integrity of such high speed signals, and also to maintain discrete wire capability in such computers or the like, coaxial cables are used; the central conductor of such cable transmits the high speed signal while the shielding or external conductor provides appropriate ground or other reference plane isolation or shielding.

Various techniques have been used for terminating such coaxial cables, but most, if not all, of such terminations have been relatively large size, bulky, and expensive. Moreover, the coaxial cables typically have been relatively heavy duty cables; for example, one coaxial cable currently used in the computer industry for high speed signal transmission is a 0.140 inch diameter cable. Due to the shear bulk of the cables and the terminations, it has not been possible to achieve a relatively high density pin out capability for connector systems for such cables. Due, at least in part to such cable size and termination size and the inability to achieve high density pin out capability for connectors for such cables, computer systems have had to be physically larger than otherwise would be necessary. As a result, efficient use of large scale integration (LSI) integrated circuits in computers has not fully been made.

A problem occurring in the past when high density electrical connections, i.e. many connections in a relatively small area, have been made, has been the lack of accuracy of the physical connector equipment due to the large size of the connectors and the difficulty, often impossibility, accurately to manufacture, specifically by molding, the same and also due to expansion and/or contraction of parts as temperatures vary. To overcome such problems in the past the pin out capabilities of such relatively high density connectors have been severely limited, e.g. to accommodate large tolerances; as a corollary, the effective pin out density capability, then, of the connection system as a whole would be diminished since the individual connector bodies would require substantial space in which connections are not actually made.

In relatively high density electrical connector systems access to individual wires for physical examination and servicing thereof was not possible without disassembling at least a substantial portion of the connector system. For example, all of the circuits of the connector system may have to be opened in order to service just one circuit. Also, in the past for checking the signals transmitted through such relatively large scale connector systems extender cards were used to provide access for signal probing. However, such extenders may introduce signal delays and, therefore, are undesirable.

SUMMARY OF THE INVENTION

The modular electrical connector system of the present invention provides relatively high density pin out capability for electrical signal coupling, especially for systems employing coaxial cables or other cable systems for high speed signal transmission with discrete wire capability while avoiding one or more of the aforementioned disadvantages. Such high pin out density is achieved using a unique terminator coupled to a cable for terminating the conductors therein, and the individual terminators may be secured in a connector block/frame holder arrangement in respective positions ready for connection with other electrical members inserted with respect to such connector block/frame arrangement and the terminators therein. The invention also enables probing of the signals carried by respective terminators without affecting such signals or other terminators by a particular tool and method, and a tool and method are provided to facilitate manipulating, for example to insert or to remove, a terminator with respect to its connector block cell without affecting the other terminators.

According to one aspect of the invention, then, there is provided a modular electrical connector system including plural terminators for terminating respective signal conductors at respective contacts, plural connector blocks, each having plural cells for receiving and holding respective terminators with the contacts thereof aligned for connection with further contacts inserted to engage the same, and a frame for holding the connector blocks securely in relative position to each other.

According to another aspect there is provided a terminator for a conductor of an electric cable, including a contact for electrically connecting the conductor with another device and electrically insulating material for insulating at least part of the conductor and contact, the insulating material including a lock for locking the terminator in a holder therefor and a deflectable means capable of selective deflection for selectively releasing the terminator from the holder.

According to an additional aspect there is provided a terminator for a conductor of an electric cable including a contact for electrically connecting the conductor with another device, electrically insulating material for insulating at least part of the conductor and contact, at least part of the contact and insulating material being insertable into a holder, and the insulating material including a surface portion to permit access of a probe for electrically connecting with part of the contact while the latter is in the holder and the contact is connectable with another device.

Moreover, another aspect of the invention relates to a tool for manipulating with respect to a holder a cable terminator coupled to a cable, the tool including an operating means for applying force to the terminator to effect such manipulation, a handle for supporting the operating means, and a means for operatively holding the tool and the cable in position to facilitate such manipulation.

Still another aspect relates to an electric signal test probe for electrically connecting with a contact of a cable terminator while the latter is positioned in a holder, the probe including a probe contact for electrically contacting the terminator contact, a support for supporting the probe contact, and a guide for guiding the probe along the terminator cable to place the probe contact in operative electrical engagement with the terminator contact.

Furthermore, an aspect of the invention relates to a method of servicing an electrical connector system for simultaneously making multiple electrical connections, the system including a holder system and plural cable terminators in the holder system in operative positions to make such electrical connections, the method including inserting and removing respective cable terminators from the back of the holder system without disturbing the electrical connections being made by other cable terminators.

Another aspect concerns a method of probing electrical signals transmitted via respective cables and terminators, the latter being held in a holder of a connector system for connecting respective circuits, including guiding a probe contact along a terminator cable, the guiding including sliding such probe contact into such holder along such terminator to engage such terminator contact.

With the foregoing in mind, a primary object of the present invention is to provide a modular electrical connector system and method that are improved in the noted respects.

Another object is to increase the pin out density of electrical connectors, especially of the type for terminating coaxial cable type high speed signal transmission systems.

An additional object is to permit physical examining and servicing of individual terminators of a connector system without requiring disassembly of the entire connector system.

A further object is to provide signal probing in a multiple pin out connector system, especially for coaxial cables, without introducing signal delays.

Still another object is to facilitate accurate insertion and removal of a cable terminator from a connector apparatus.

Still an additional object is to provide in a modular electrical connector system the capability of expansion to accommodate a desired pin out capability.

Still a further object is to maintain the contact alignment accuracy in a relatively high density multiconnection connector system while minimizing the tolerance requirements of the parts thereof.

Even another object is to reduce the size of wire required for high speed signal transmission purposes, especially in a computer system, and, as a corollary, to increase the signal carrying density in such a system.

Even an additional object is to reduce the cost per connection in a signal transmission system, such as a computer system.

Even a further object is to provide effective reference potential, e.g. ground, plane for optimizing the efficiency of high speed signal transmission.

These and other objects and advantages of the present invention will become more apparent as the following description proceeds.

To the accomplishment of the foregoing and related ends, the invention, then, comprises the features hereinafter fully described in the specification and particularly pointed out in the claims, the following description and the annexed drawings setting forth in detail certain illustrative embodiments of the invention, these being indicative, however, of but several of the various ways in which the principles of the invention may be employed.

BRIEF DESCRIPTION OF DRAWINGS

In the annexed drawings:

FIGS. 1 and 2 are, respectively, front and back isometric views of a modular electrical connector system in accordance with the present invention;

FIG. 3 is a top plan view of a terminator in accordance with the present invention;

FIG. 4 is a side elevation view of the terminator looking generally in the direction of the arrows 4—4 of FIG. 3;

FIG. 5 is a bottom plan view of the terminator looking generally in the direction of the arrows 5—5 of FIG. 4;

FIG. 6 is a front view of the terminator looking generally in the direction of the arrows 6—6 of FIG. 3;

FIG. 7 is a back view of the terminator looking generally in the direction of the arrows 7—7 of FIG. 3;

FIG. 8 is an enlarged fragmentary side elevation view of the terminator body showing particularly the anchoring hook and removal recess, which are shown on smaller scale in FIG. 4;

FIG. 25 is an enlarged section view through an end portion of the modular connector system with terminators in the first three left hand positions;

FIGS. 30, 31 and 32 are, respectively, side, end and front views of a terminator probe tool.

DETAILED DESCRIPTION OF THE INVENTION

Figure 2B:
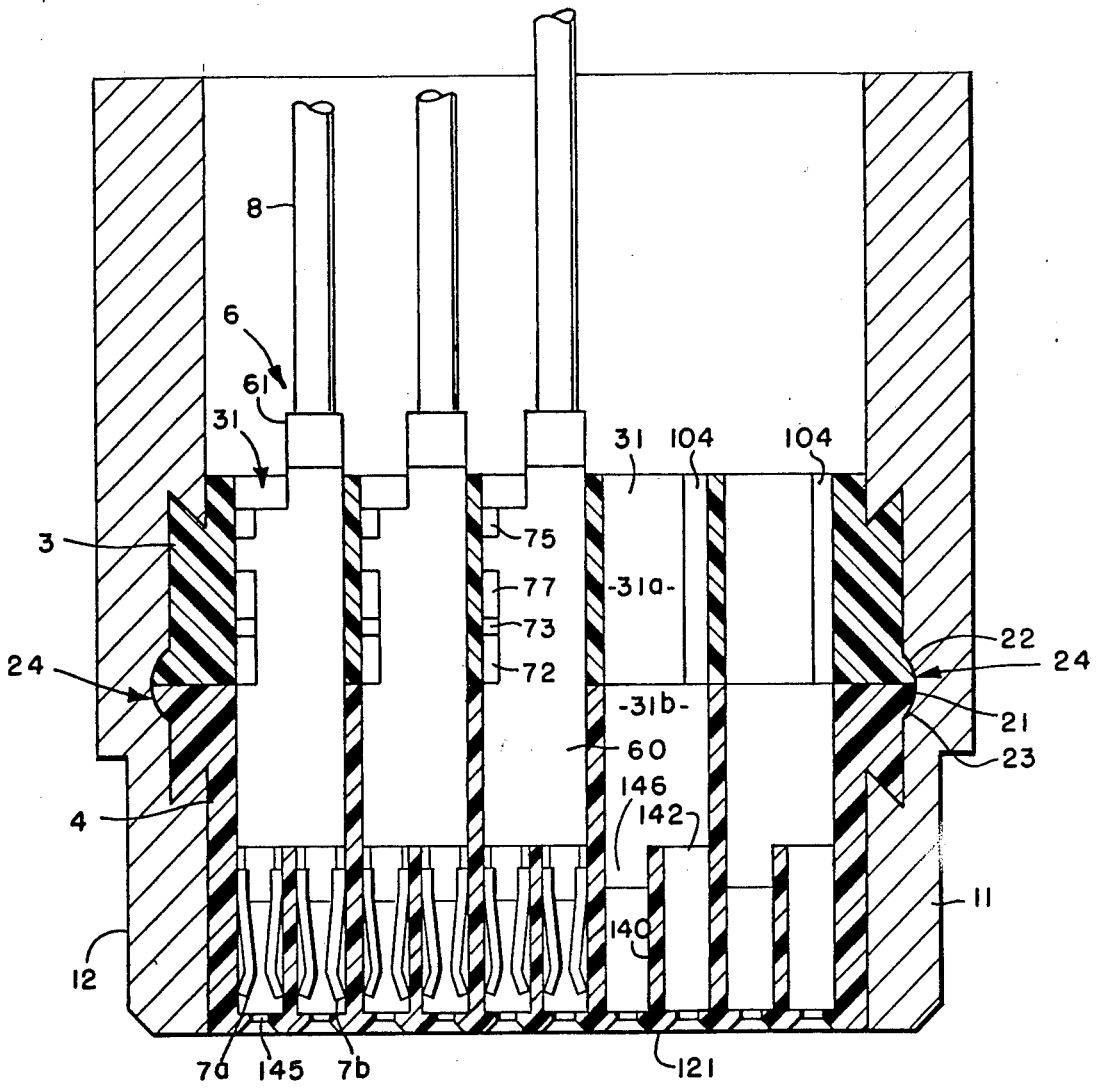
Figure 27:
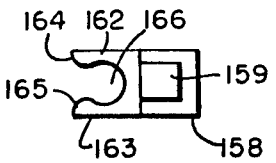
FIGS. 26, 27, 28 and 29 are, respectively, side, front end, back end, and front views of a terminator insertion and removal tool.
Figure 28:
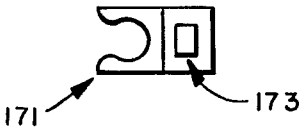
Figure 26:
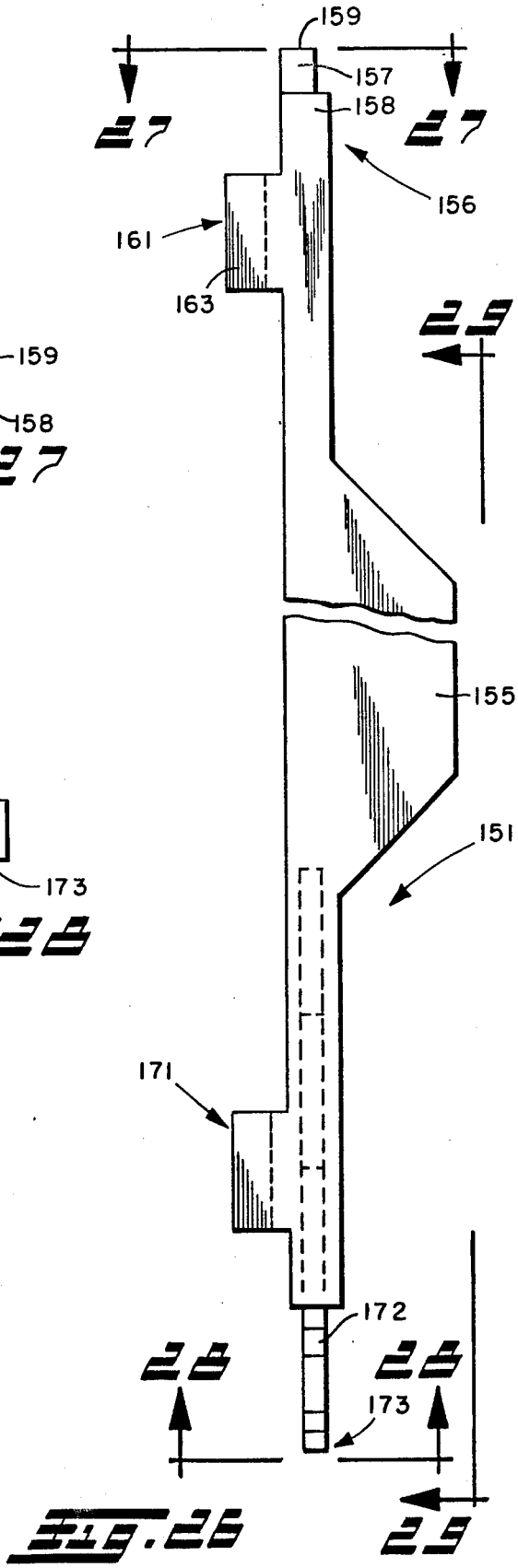
Figure 29:
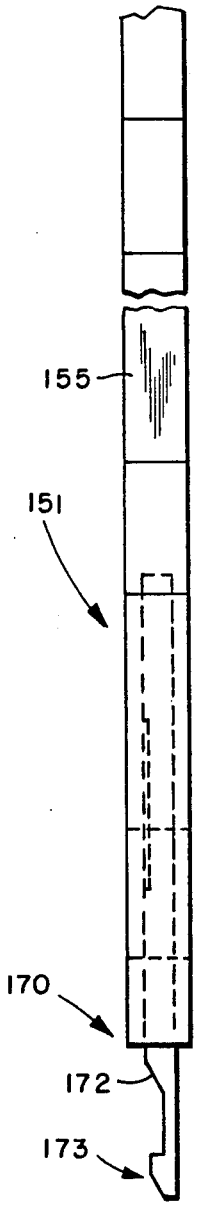

Referring now in detail to the drawings, wherein like reference numerals designate like parts in the several figures, and initially to FIGS. 1 and 2, a modular electrical system in accordance with the present invention is generally indicated at 1. The system 1 includes plural groups 2 of connector block modules, each of which includes an inner connector block 3 and an outer connector block 4, securely held in a frame 5, and cable terminators 6. The length of the frame 5 may be selected to any length desired to accommodate a particular number of connector block groups 2, the number thereof indicating the total number of pin out connections of which the system 1 would be capable. More specifically, each connector block group 2 includes cells for receiving respective cable terminators 6 to hold the contacts 7 (FIGS. 3–6) in relatively closely packed fixed positions. The contacts 7 are intended to provide connections for the conductor or conductors of a cable 8.

In accordance with the invention it is intended that the system 1 have a relatively high density pin out capability, the ability to expand or to reduce the number of groups of connector block modules without significantly affecting the pin out density, and the advantages of discrete wire capabilities, this all especially when the discrete wire is, in fact, a coaxial cable type for high speed signal transmission. As will become clear from the following, these features may be achieved, inter alia, by the improved terminator 6 enabling use of smaller cables 8, especially of the coaxial type, than was heretofore possible and by the interrelationship of the modular connector blocks 3, 4 with respect to the frame 5 to accommodate large pin out capabilities without detrimentally affecting contact alignment accuracy.

Frame 5 is formed of top and bottom rails 11, 12 and left and right end blocks 13, 14, all of which may be fastened together in the manner shown in FIGS. 1 and 2 by screws 15. Various directions, such as top, bottom, left and right, are mentioned herein to facilitate reference to the drawings, but otherwise are not intended to restrict the disclosure. The rails and end blocks preferably are of metal and they are maintained at ground reference potential providing an added measure of shielding for the contacts 7 therein which are not otherwise individually shielded. A dovetail shape groove 16, 17 is formed in each rail 11, 12 to accommodate dovetail prism-like projections and undercuts in the end blocks 13, 14 and groups of connector blocks 3, 4 (FIG. 25) properly to align and to hold the same in the frame 5. Rail guide holes 18 in the end blocks 13, 14 provide for sliding mounting of the modular connector system 1 on mounting rails, for example in a cabinet of a computer. Jack screw holes 19 in the end blocks may receive relatively heavy duty jack screws that may be tightened in one direction or another to move the modular connector system 1 along such rails, for example toward or away from a similar modular connector system to effect electrical connections with respect thereto.

Each of the top and bottom rails 11, 12 has one or more accurately positioned alignment openings or detents 21. The openings 21 cooperate with protrusions 22, 23 on the connector blocks 3, 4 to form a detent coupling 24, as is seen more clearly in FIG. 25. The detent couplings allow the blocks to be injection molded relatively easily without severe tolerance requirements. The relatively small blocks 3, 4 may be coupled with others as modules in the frame 5 to achieve the desired accurate pin out requirement without encountering the great difficulties of molding a very large connector block. A corollary to this connector approach is that gaps 25 may be provided between adjacent groups 2 of inner and outer connector blocks 3, 4 to accommodate the maximum anticipated expansion of respective adjacent connector blocks as they may expand with temperature variations, so that any such expansion is not cumulative along the entire longitudinal length of the system 1. Expansion or contraction of a group 2 of connector blocks will be with respect to the particular detent coupling 24 between such group and the rails 11, 12, as such detent coupling 24 maintains relatively accurate positioning of the respective groups in the frame 5. Accordingly, tolerances required in the system 1 may be minimized to those adequate to accommodate dimensional variations with respect to temperature of only a single group 2 of connector blocks 3, 4.

To use the modular electrical connector system 1, one or more terminators 6 are inserted into respective holder cells generally indicated at 31 at the back end 32 of the system with the contacts 7 pointing toward the front end 33. The system 1 may be mounted on rails (not shown) and may be tightened in a manner to cause pin contacts from a similar modular connector system to be inserted into respective cells for mechanical and electrical connection with the respective contacts 7, which in the illustrated embodiment are female type fork contacts. If desired, the frames 5 of both the male and female modular connector systems may be electrically connected so as to be maintained at a common ground potential, and such frames may be brought into engagement with each other thereby providing full shielding about the contacts, the interconnections thereof, and the junctions of respective contacts with signal carrying conductors.

Turning now to FIGS. 3–8, a terminator 6 in accordance with the present invention for use in the modular connector system 1 is shown in detail. The terminator 6 includes a portion 40 of the cable 8, one or more contacts 7, the connection(s) or junction(s) 41 of the contact(s) and the conductor(s) of the cable 8, and electrically insulating material 42, which holds the cable, conductors and contacts in secure relatively fixed spatial relation. Preferably the insulation material 42 is a plastic or plastic type of material that is molded directly about and to at least part of the cable portion 40, junctions 41, and contact(s) 7 in a manner that provides substantially hermetic encapsulation of the junction(s) 41, on the one hand, and secure strain relief retention of the cable 8 in the material 42 without applying strain to the junction(s) 41. The insulating material 42 also preferably is relatively rigid, on the one hand, to facilitate manipulating the same, for example to insert or to remove the same from a cell 31, and, on the other hand, is adequately flexible to enable both the locking and removal functions described in greater detail below.

The cable 8 is a coaxial cable having a central signal carrying conductor 43 surrounded by a separate insulation material 44, an electrically conductive foil (not shown) providing the shielding function, a drain wire 45 electrically engaged with the foil to assure maintaining ground reference potential thereof, and a peripheral layer of insulation 46, such as, for example, a tetrafluoroethylene (TFE) electrical insulation material. It will be appreciated, though, that the invention may be used with other types of cables, although due to the nature of the terminator 6, such coaxial type cable using a foil and drain wire for the ground plane shielding function may be used quite efficiently in accordance with the present invention, and such a cable is known to have a physical size, specifically diameter, that is appreciably smaller than the conventional relatively heavy duty coaxial cables typically used in computer systems and the like where high speed signal transmission is desired.

To terminate or to provide pin out capability for the signal conductor 43 and drain wire 45, the terminator 6 includes two contacts *7a, 7b,* each of which preferably has a pair of tines 47 that preferably have gold material 48 at the front portions 49 of the contacts where they engage respective pin contacts inserted between the tines in conventional manner. (In the modular connector system 1 illustrated in the drawings the contacts 7 are of the female type which are recessed within respective cells 31. However, if the contacts 7 were of the male type, such as pin contacts, then portions of such pins ordinarily would extend beyond the front of the outer connector block 4 for insertion into respective cells of a female system 1 to engage the female contacts therein.) The contacts *7a, 7b* have mold through holes 51 through which the insulating material 42 may flow to secure the contacts in place, and the back portions 52 of each contact are attached, for example by soldering or welding, to the signal conductor 43 and drain wire 45 of the cable 8, as is illustrated. For the reasons described below the contact *7a* has a step 53 offsetting the planes of the top surface 54 of the forward end of the contact and the top surface 54 of the back or contact fastening end surface 52 while preferably maintaining the parallel relation of such planes. The contact *7b* also preferably, although not necessarily, has such a step to cause the planes of the corresponding surface portions thereof to be parallel with those of the contact *7a*, as is seen, for example, in FIGS. 4 and 6.

The insulating material 42 is formed as a terminator body generally designated 60 molded in place to the cable and contacts. The terminator body 60 includes a relatively large, for example square cross-section, strain relief end block 61 intended securely to hold the cable 8 to the terminator body, a main support body portion 62, and a multifunction body strip portion 63 intended to facilitate probing, locking or anchoring, and removing of the terminator 6. The cross-section of the main support body portion 62 is generally rectangular and continuous over the linear extent thereof; such cross-section is somewhat smaller than that of the strain relief end block 61 and larger than that of the multifunction body strip 63 so as to provide a major strength and support function of the terminator body 60. However, along one edge of the main support body portion 62 remote from the multifunction body strip 63 is a chamfer 64 extending from the front or leading edge 65 of the terminator body 60 to the back 66 thereof ending at the strain relief block 61 (shown in FIG. 6) to provide a polarization guide for the terminator 6 to assure it is inserted in a cell 31 in the correct direction, i.e. relative orientation of the signal contact *7a* and ground contact *7b*.

Molded as an integral portion of the multifunction body strip 63 on the surface 70 thereof is a locking or anchoring hook 71, which includes an anchor ramp 72 that slopes away from the surface 70 and a surface flat 73. When the terminator 6 is inserted into a cell 31, it is intended that the anchor ramp 72 cooperate with an impediment in the cell to cause some resilient deflection of the multifunction body strip 63. When the anchor ramp 72 has moved past such impediment, the resilient multifunction body strip 63 would deflect or snap back to its original unstressed condition and relation to the main support body portion 62, whereupon the back surface 74 of the anchoring hook 71 effectively locks the terminator body 60 in the cell 31. The surface flat 73 is provided in lieu of a sharp apex where the anchor ramp 72 and back surface 74 otherwise would meet; such a sharp apex would be subject to a relatively large concentration of force that may break some of the material of the anchoring hook. In contrast, the surface flat 73 spreads such forces and avoids such breakage.

At the surface 70 the multifunction body strip 63 also includes a means for enabling removal of the terminator from the cell 31; these includes a sloped or tapered guide surface 75 at the back end 76 of the strip 63, a removal recess 77 just behind the anchoring hook 71, and a forward sloping of the back anchor surface 74, as is seen more clearly in FIG. 8. To effect such removal, a tool, which will be described in greater detail below, is inserted in the cell 31 and is guided by the tapered surface 75 onto the surface 70 of the multifunction body strip 63 while deflecting the same. Further insertion of the tool enables a hook end portion thereof to fit into the removal recess 77. Rotating the tool causes the hook thereof to apply force a the removal recess 77 tending to deflect the multifunction body strip 63 in a manner that moves the anchoring hook 71, and particularly the surface flat 73, away from the locked position thereof with respect to the aforementioned impediment. The hook on such tool then may engage the back surface 78 of the removal recess and may be used to pull the terminator 6 from the cell 31. If the anchoring hook 71 is not fully released from such impediment, but at least is partially freed therefrom, the angled surface 74 will facilitate the desired removal, while the surface flat 73 avoids breakage due to force concentrations upon such removal. After the terminator body 60 has been freed or removed from the cell 31 or otherwise has been moved to a position such that no further stress is applied to the multifunction body strip 63, the latter will resume its normal shape relation with respect to the main support body portion 62.

As is illustrated in FIGS. 4, 5 and 6, the planar surface 70 extends substantially continuously over both the multifunction body strip 63 and the main support body portion 62, and it is intended that such surface 70 fit relatively closely to a generally mating wall in a cell 31 while, on the other hand, the surface 80 of the main support body portion 62 also is positioned in relatively close fitting relation with respect to an opposite wall of such cell. Therefore, the surfaces 70, 80 in cooperation with such cell walls generally prevent significant movement of the terminator body 60 in a direction perpendicular to the planes of such walls.

As was mentioned above, the cross-section, and particularly the thickness of the multifunction body strip 63 is reduced relative to that of the main support body portion 62. Accordingly, the thickness dimension between the surface 70 and a stepped down slide surface 81 of the multifunction body strip 63 is less than the thickness of the main support body portion 62 in the same direction. Such reduced thickness not only facilitates insertion, locking and removal of the terminator 6 with respect to a cell 31, but also enables electrical probing of the contact *7a* as the latter is actively carrying electrical signals while functionally inserted in a cell 31 of the modular connector system 1. In particular, due to the step 53 in the contact *7a*, the generally planar surface portion 54 of the contact is coplanar with the slide surface 81. Moreover, since such slide surface is stepped down from the surface 80, clearance between a wall of the cell 31 and the slide surface 81 is provided to accommodate an electrically conductive probe contact. Such probe contact may be inserted in the cell 31 and slid along the surface 81 to effect electrical connection with the surface 54 of the contact *7a*. Accordingly, dynamic real time probing can be effected without the need for extender cards or the like, thereby avoiding the various disadvantages of such extended cards.

In the modular connector system 1 of FIGS. 1 and 2 there are six groups 2 of inner and outer connector blocks 3, 4. However, it will be appreciated that there may be fewer or more such groups, depending on the desired size of the system 1. The following detailed description relating to FIGS. 9–25 exemplifies a typical group or pair of inner and outer connector blocks 3, 4 and their interrelationships with each other, with the frame 5, and with a terminator 6. In the present invention a pair or group 2 of inner and outer connector blocks 3, 4 is needed to provide the means required to isolate the pair of electrical contacts *7a*, *7b* of each terminator 6, to lock the terminator in a respective cell 31 formed by the connector blocks (and to permit facile removal), and to enable the above described electrical probing, while still permitting the connector blocks to be plastic injection molded or similarly manufactured. However, it may be possible, and would be equivalent to the connector block pair arrangement illustrated as the preferred embodiment of the invention, if another manufacturing technique were employed, to make the connector block pair as more or fewer than two pieces while still providing the desired functions thereof, such as the walls, cells, surfaces, impediments, etc.

Referring now to FIGS. 9–15, the inner connector block 3, which ordinarily is positioned at a relatively inner or back portion of the frame 5 so that the back wall 90 is accessible for insertion and removal of a terminator 6, is shown in detail. At the upper and lower sides 91, 92 are formed partial dovetail prism-like members 93, 94 intended to fit in the respective dovetail slots 16, 17 and to cooperate therewith and with corresponding dovetail prism or wedge-like undercut portions 95, 96 (FIGS. 18 and 19) of the outer connector block 4 to secure the respective group of connector blocks in the frame 5. The detents 22 are half hemispherical in shape and preferably are located on the side walls 91, 92 about centered on the connector block 3 and adjacent the front or juncture wall 97 for cooperation with the corresponding detents or protrusions 23 of the outer connector block 4 and alignment openings 21 (FIG. 1) of the frame 5 as aforesaid. The end walls 98, 99 preferably are flat so as to be parallel with corresponding end walls of an inner connector block of an adjacent group 2 in order to minimize the size of the gap 25 required therebetween.

Figure 10:
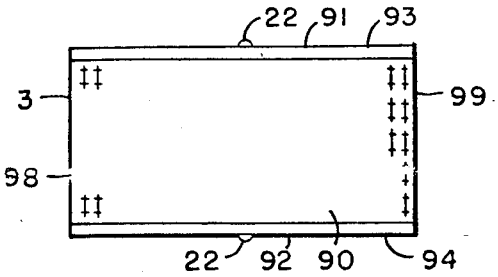
FIGS. 9, 10, 11 and 12 are, respectively, side, back, front and end views of an inner connector block used in the modular connector system of FIGS. 1 and 2.
Figure 9:
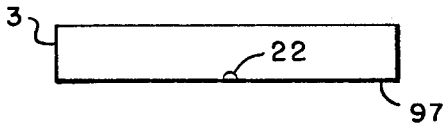
Figure 11:
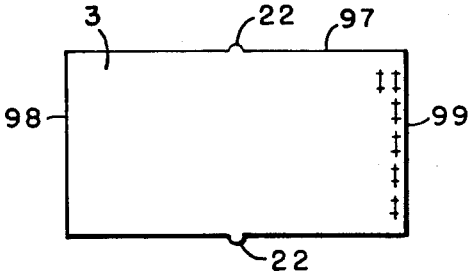
Figure 12:
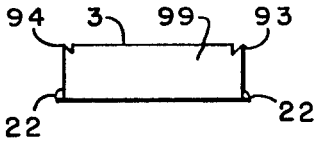
Figure 15:
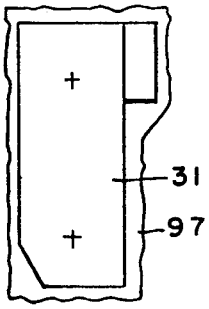
FIG. 15 is an enlarged fragmentary front view of a terminator receiving cell in such connector block.
Figure 13:
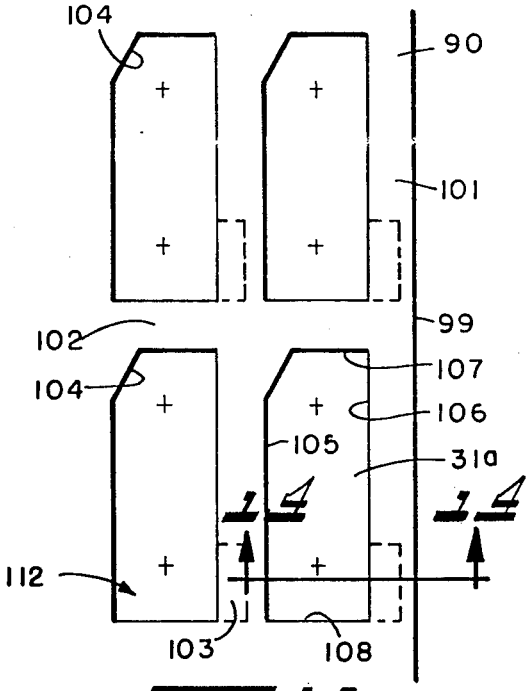
FIG. 13 is an enlarged fragmentary back view of such connector block.
Figure 14:
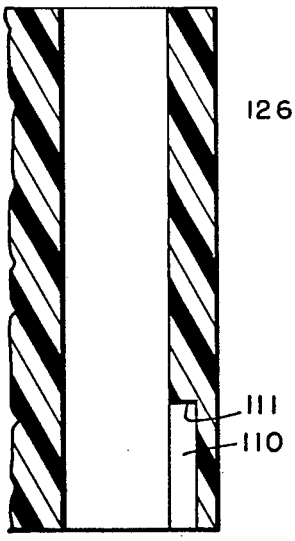
FIG. 14 is a fragmentary section view looking generally in the direction of the arrows 14—14 of FIG. 13.
Figure 19:
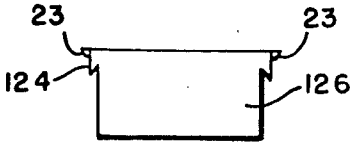
FIGS. 16, 17, 18 and 19 are, respectively, side, back, front and end views of an outer connector block used in the modular connector system of FIGS. 1 and 2.

In FIGS. 13, 14 and 15 details of a typical inner cell 31*a*, i.e. that portion of a cell 31 located in the inner connector block 3, are shown. It is into the inner cell 31*a* that a terminator 6 initially is inserted as part of the process of fully inserting the terminator into a cell 31 to complete a modular connector system 1. The back wall 90 of the inner connector block 3 essentially is formed by peripheral walls 101 about the perimeter of the back wall, and vertical and horizontal cell divider walls 102, 103. Each cell 31*a* is of a size adequate to receive the entire cross section of a terminator 6, including the contacts *7a*, *7b* and the terminator body 60, as such terminator is inserted contacts first into the inner cell 31*a* at the back wall 90. A polarization keying surface 104 at a corner of each cell 31*a* cooperates with the polarization guide surface 64 on the terminator body 60 to prevent insertion of the terminator in an incorrect orientation. The side mating walls 105, 106 cooperate with the respective surfaces 70, 80 of the terminator body 60, and the cell walls 107, 108 cooperate similarly with corresponding walls of the terminator body to locate the same relatively securely in the cell 31*a*. At the front or juncture wall 97 is a hook accommodating recess intended to receive the anchoring hook 71 (FIG. 4), and at the back end of that recess is a hook securing end wall surface 111 intended to cooperate with the wall 74 (FIG. 4) to provide the above-mentioned impediment that prevents undesired removal of the terminator from its cell 31. The zone 112 is the area through which a probe contact may be inserted to engage the contact *7a* surface 54, as is described further below.

Figure 17:
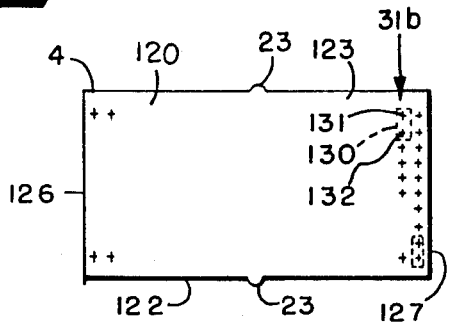
Figure 16:
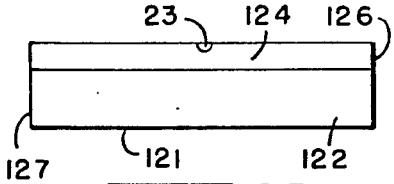
Figure 18:
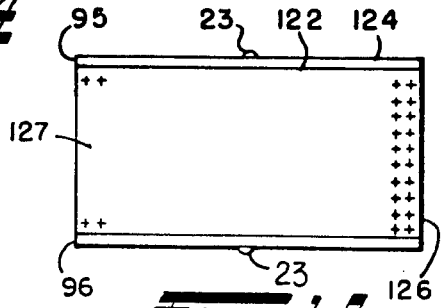

Turning now to FIGS. 16–22, details of the outer connector block 4 are illustrated. The block 4 has a back or juncture wall 120 intended to fit in flush engagement with the front juncture wall 97 of the connector block 3, and a front wall 121 intended for exposure at the front end 33 of the modular connector system 1. Top and bottom side walls 122, 123 are formed with dovetail wedge-like prisms and undercuts 124, 125 for cooperating with the corresponding elements 93, 94 of the inner connector block 3 to mate with the dovetail slot or groove 16, 17 in the frame rails 11, 12. The dovetail wedges 124, 125 are recessed back from the front wall 121 so that such front wall may be positioned substantially in a coplanar relation with the front edges of the rails 11, 12 at the front end 33 of the modular connector system 1, as is seen, for example, in FIG. 1. The protrusions or detents 23 preferably are generally centrally located on the top and bottom walls adjacent the back or juncture wall 120 and are of half hemispherical shape for cooperation with the detents 22 (FIG. 10) to form true hemispherical detents for insertion in the respective alignment openings 21 of the rails 11, 12 (FIG. 1). End walls 126, 127 preferably are flat like the end walls 98, 99 to minimize the size of the cap 25 required to accommodate conventional variations in a single connector block so as not to accumulate such variations along the length of the modular connector system 1. As is seen in FIG. 17 each outer cell 31*b* (termed outer because it is in the outer connector block 4) is comprised of a main outer cell portion 130 outlined in an exemplary dotted line and a pair of sub-cell portions 131, 132. The main outer cell portion 130 is approximately the same size and shape as the inner cell 31*a* to receive the front or leading portion of the terminator body 60, and the sub-cell portions 131, 132 receive the contacts *7a*, *7b* of a given terminator 6 while providing physical and electrical isolation between such contacts to avoid short-circuits between the signal and ground contacts.

Figure 20:
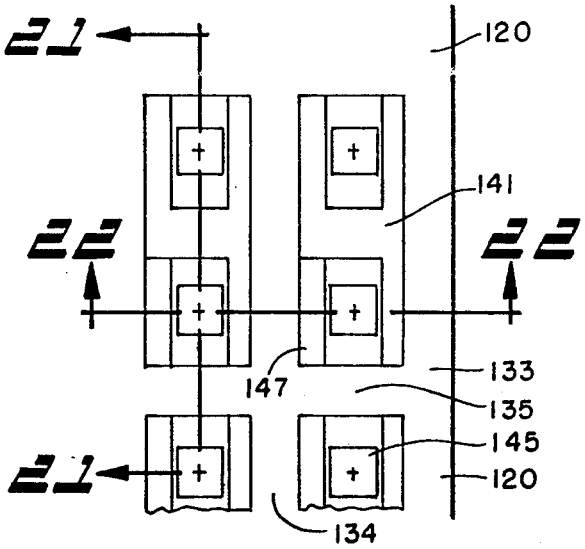
FIG. 20 is an enlarged fragmentary back view of the outer connector block.
Figure 22:
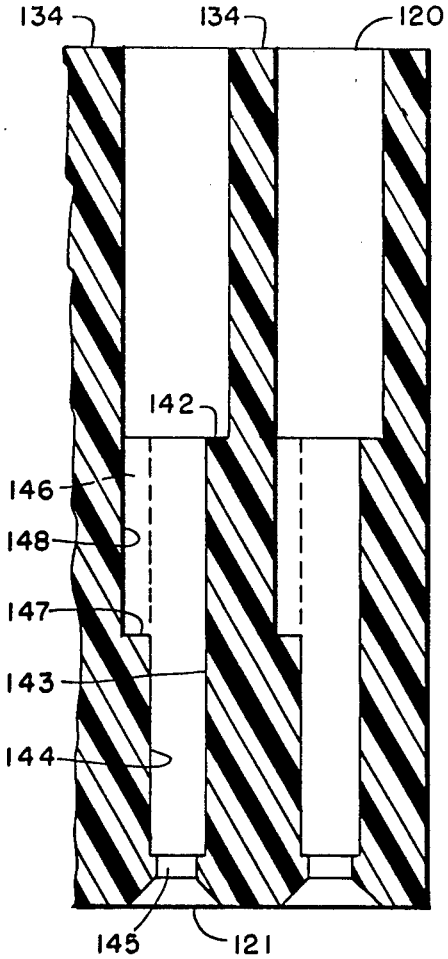
FIGS. 21 and 22 are section views taken, respectively, along the lines 21—21 and 22—22 of FIG. 20.
Figure 21:
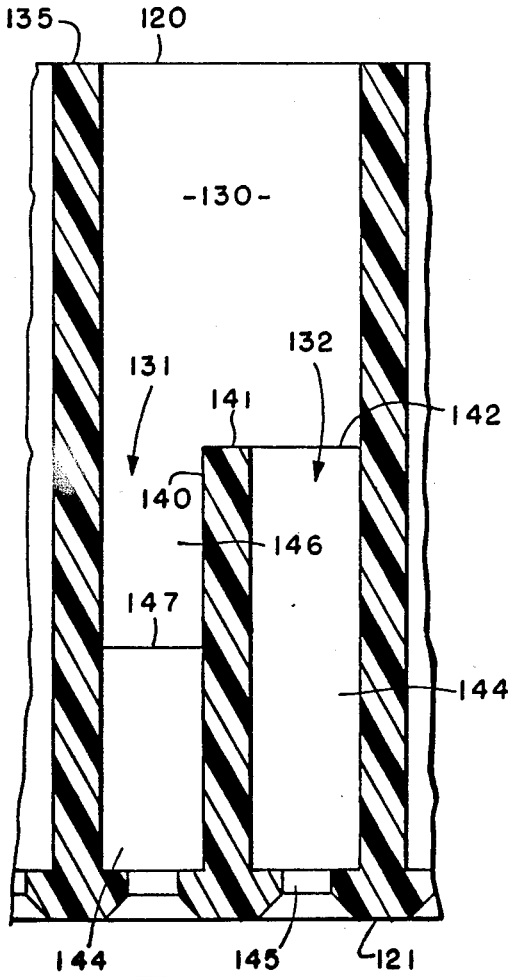

Enlarged views of portions of the outer connector block 23 are shown in FIGS. 20–22. The back or juncture wall 120 is formed by a peripheral wall 133 about the perimeter of the outer connector block 4 and by vertical and horizontal main cell divider walls 134, 135, all of which preferably are coplanar and able to mate in planar relation with the front juncture wall 97 of the inner connector block 3. As is seen in FIGS. 21 and 22, the divider walls 134, 135 extend from the surfaces thereof at the back or juncture wall 120 to the front wall 121. A sub-cell partition 140 in each cell 31*b* separates the sub-cell portions 131, 132 at the forward end of the connector block 4, and the rearward surface 141 of such sub-cell partition provides an insertion stop for the leading wall or edge of the terminator body 60 to limit the maximum insertion depth thereof into the given cell 31. A step 142 at the back end of each sub-cell portion 131, 132 also provides a terminator body stop in cooperation with the surface 141 and provides a relatively narrow width between the wall surfaces 143, 144 adequate to accommodate the thickness dimension of the contacts 7a, 7b (the thickness dimension being the vertical dimension seen in FIG. 4) while effecting a measure of confinement for the contacts to avoid physical displacement, distortion, or the like thereof, e.g. in response to the force of a pin contact inserted to engagement therewith via access holes 145 at the front 121 of the connector block 4. Such access holes, too, are tapered in the manner illustrated in FIGS. 21 and 22, for example, to help guide such pin contacts into the respective sub-cell portions 131, 132. Furthermore, a relief zone 146 is provided in the wall 134 at the back portion of the sub-cell portion 131, and such relief zone ends at a relief step 147 to provide a coupling between the wall 144 and the surface 148 of the wall 134. The relief zone 146 provides an area into which a contact probe may be inserted to effect an electrical connection with the contact *7a;* the relief step 147 provides a stop for such probe contact to limit the insertion depth thereof. As is seen in FIGS. 20 and 21, the relief zone 146 preferably is provided only for the signal carrying contact *7a,* i.e. in the sub-cell portion 131.

Figure 23:
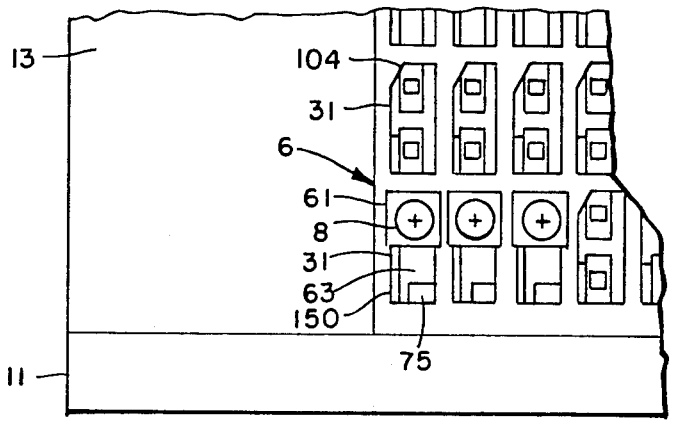
FIG. 23 is an enlarged fragmentary back view of the modular connector system showing terminators inserted into the three cells in the lower left hand positions of the inner connector block.

Referring now to FIG. 23, an enlarged back view of the modular connector system 1 is shown with terminators inserted into respective cells at the illustrated three lower left positions. At each terminator 6 can be seen the strain relief block 61, the coaxial cable 8 exiting out of the plane of the taper, the multifunction body strip 63, and the guide surface 75. A probe zone 150 is provided between the multifunction body strip 63 and the wall of the cell 31 permitting access of a probe contact therein to engage the terminator contact *7a.* The probe zone 150 also provides an area into which the multifunction body strip 63 may be deflected as a removal tool is inserted along the guide surface 75 and to the removal recess 73 of the terminator body. Such deflection is illustrated in FIG. 24.

Figure 24:
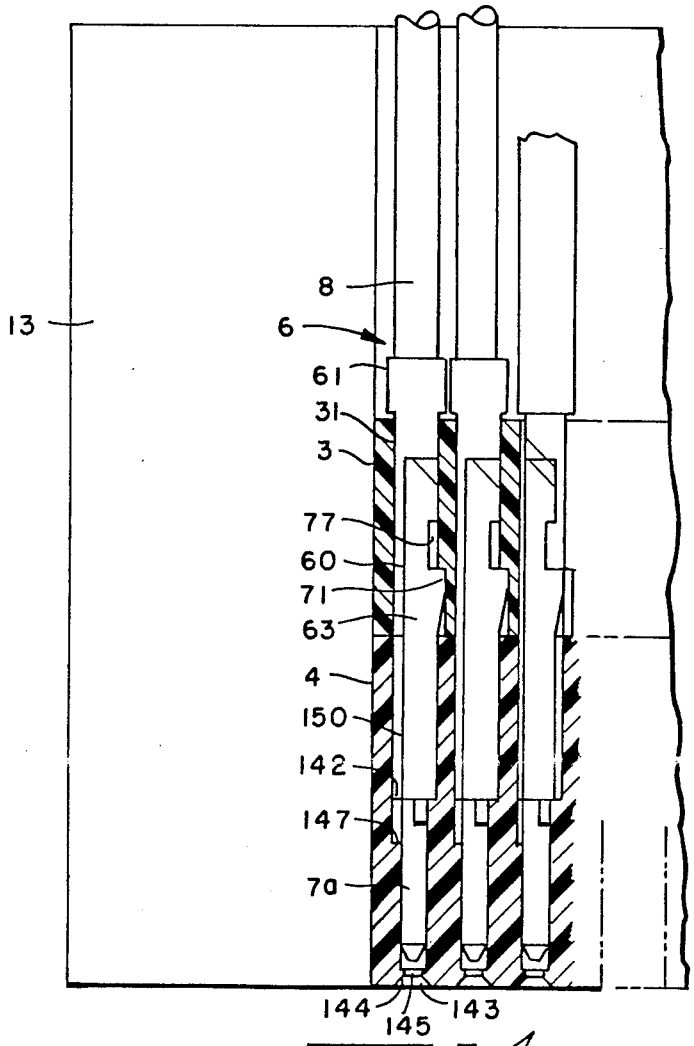
FIG. 24 is an enlarged fragmentary partial section view depicting use of the modular connector system.

More specifically, with reference to FIG. 24, which is an enlarged fragmentary view of the modular connector system 1 with terminators inserted in the cells 31 of the first three left hand positions in a given row of cells, the positional interrelationships of the inner and outer connector blocks 3, 4 with respect to each other and with respect to terminators therein are shown, as are the various interrelationships of the terminators 6 and cells 31. The probe zone 150 accommodates the probe contact, as aforesaid, while also accommodating deflection of the multifunction body strip, as is illustrated in the third position from the left in FIG. 24 where a removal tool 151 already has been inserted ready to remove the terminator 6 from such cell. Cooperation of the anchoring hook 71 with the hook accommodating recess 110 and securing end wall surface 111 is seen in the first two cell positions, and in all three the secure support function of the contacts 7 by the outer connector block wall surfaces 143, 144, and the terminator body stop walls 141, 142 also are seen. Ordinarily to remove a terminator, the hook 152 of the tool 151 is inserted along the ramp 75 and multifunction body strip until the hook enters the removal recess 77 and is manipulated, if necessary, to lock therein and to pull the terminator from its cell.

Referring to FIG. 25, which is an enlarged end section view of the modular connector system 1 looking in, for example, from the left end, terminators are in the first three cell positions. The sub-cell partition 141 provides part of the terminator body stop function and separates the signal and ground contacts *7a, 7b.* The dovetail connection between the top and bottom rails 11, 12 and the respective pairs of connector blocks 3, 4 clearly is illustrated.

Turning now to FIGS. 26–29, the tool 151 for inserting and removing a terminator from its cell 31 is shown. The tool 151 includes a handle 155 and may be manually grasped by a person to effect manipulation of the tool to insert or to remove a terminator 6 relative to its cell 31. The handle 155 may be formed of a single piece of molded plastic type material. At the insertion end 156 protrudes a blunt pushing end or means 157 of slightly stepped down cross section from back of the main portion 158 of the handle and preferably molded as an integral portion thereof. It is intended that the end 159 of the pushing means push against the back end 160 (FIG. 3) of the multifunction body strip 63 to urge a terminator into a cell. The cross section of the pushing means 157 is of a size permitting it to fit in the cell to push the terminator body 60 into a locked position in the cell. The insertion end 156 also includes a clip-like device 161 for holding the tool 151 to the cable 8 of the terminator intended to be inserted. The clip-like device 161 preferably is molded as an integral portion of the handle 155 and includes resilient arms 162, 163 and detents 164, 165 capable of holding a cable 8 in the interior 166 of the clip-like device. Accordingly, the opening dimension between the detents 164, 165 is smaller than the diameter of the cable 8 so that the cable can be snapped into the interior 166 for retention therein. However, it is preferred that the clip-like device 161 enable relative sliding of the tool with respect to the cable to which the tool is clipped to facilitate the manipulating functions and withdrawal of the tool after a terminator has been inserted without affecting other terminators and cables already inserted in respective cells.

At the removal end 170 is a clip-like device 171 similar to the clip-like device 161 described above and performing similar functions. Also, a metal hook member 172 is molded in the tool 151. The member 172 has a hook end 173 for grabbing into the removal recess 77 as was described above. During use of the tool 151 for removing a terminator from a cell, it is intended that the clip-like device 171 be clipped onto the cable 8 of the terminator intended to be removed, and then the tool is slid along such cable guided thereby to the correct terminator intended for removal. Such sliding and guiding facilitates locating the correct terminator for removal, especially when the modular connector system 1 is substantially full of terminators in a relatively high density arrangement therein.

A probe tool is illustrated in FIGS. 30–32 at 180. The tool includes a handle 181 preferably of molded plastic type material capable of being held by a user to effect the desired probing function. At the probe end 182 of the handle an elongate electrically conductive probe contact 183 is secured by molding a portion of the handle 181 about a portion 184 of such probe contact. Attached to the probe contact portion 184 is a conductor 185, which also is molded into the handle in the manner shown, and such conductor and the insulation thereabout exit the handle at a heat shrink tubing strain relief 189. The conductor 188 is coupled to an electrical connector 190, such as a Bendix connector No. 33344-2, which is a conventional connector used to couple signals to an oscilloscope input device. Another conductor 191 is intended as a ground or other reference potential connection to which the signal received at the probe contact 183 may be referenced.

In the preferred embodiment of the present invention the frame 5 of the module electrical connector system 1 is electrically conductive, and is maintained at the same reference potential, e.g. ground, as the contacts *7b;* therefore, the conductor 191 may be connected directly to, for example, one of the top or bottom rails 11, 12. The length of that contact portion 192 that extends outside of the handle portion 182 is adequate to pass through the probe contact zone 150 to the exposed area of contact *7a* without the handle portion 182 entering the cell 31. At the leading end of the probe contact 192 is an offset curve 193 that fits in very close tolerance relation in the probe zone 150 and particularly in the relief zone 146 to assure electrical engagement with the contact *7a.* A clip-like device 194 of the type described above with reference to the tool 151, is molded as an integral portion of the handle 181 and is oriented thereon to clip onto the cable of the terminator 6 intended to be probed by the probe contact 183. Being on the side of the contact, as seen more clearly in FIGS. 31 and 32, the clip-like device 194 guides the probe 180 along such cable, which is slightly offset in the manner shown in FIG. 23 from the probe zone 150 at the back end of a cell 31, so that the probe contact 183 will be guided directly into the correct probe zone. As a result, the probe tool 180 may be conveniently used to probe signals on virtually any signal conductor/contact in the modular connector system 1 simply by locating the correct cable intended to be probed even though there is a high density merging of such cables and terminators where they enter respective cells 31.

STATEMENT OF INDUSTRIAL APPLICATION

In view of the foregoing it will be appreciated that the present invention may be used to effect multiple electrical connections in a highly efficient manner while maintaining accuracy of high speed signal transmission and discrete wire capability together with convenient servicing and signal probing abilities.

We claim:

1. A connector system comprising plural terminator means for terminating respective insulated conductors, each said terminator means including contact means for electrically connecting the respective conductor with another device; at least one pair of connector blocks, the connector blocks of said one pair including plural cell means for receiving and holding respective said terminator means with said contacts thereof aligned for connection with contacts of such another device; frame means for holding said one pair of connector blocks securely therewithin, said frame means having a dovetail slot, said connector blocks of said one pair having respective portions of a dovetail prism-shape member, and said portions of said dovetail prism-shape member cooperating with each other and with said slot to connect said connector blocks of said one pair together in said frame means.

2. A connector system as set forth in claim 1, wherein said frame means includes a pair of frame members between which said one pair of connector blocks are positioned, said frame members have respective dovetail slots, and said connector blocks of said one pair have at opposite sides thereof respective dovetail prism-shape members, said connector blocks of said one pair having respective portions of each dovetail prism-shape member, and said portions of said dovetail members on opposite sides of said connector blocks cooperating with respective said dovetail slots to connect said blocks together in said frame means.

3. A connector system as set forth in claim 2, comprising a plurality of said pairs of connector blocks located within said frame means in side-by-side, spaced apart relation.

4. A connector system as set forth in claim 3, wherein said pairs of blocks are located in side-by-side, spaced apart relation by protrusion and detent means.

5. A connector system as set forth in claim 4, wherein said connector blocks of said one pair have mating surfaces, and said protrusion and detent means includes a protrusion formed in part on one of said connector blocks adjacent the mating surface thereof and another part on the other of said connector blocks adjacent the mating surface thereof.

6. A connector system as set forth in claim 5, wherein said dovetail prism-shape members include said mating surfaces.

7. A connector system as set forth in claim 1, comprising a plurality of said pairs of connector blocks located within said frame in side-by-side, spaced apart relation.

8. A connector system as set forth in claim 7, wherein said pairs of blocks are located in side-by-side, spaced apart relation by protrusion and detent means.

9. A connector system as set forth in claim 8, wherein said connector blocks of said one pair have mating surfaces, and said protrusion and detent means includes a protrusion formed in part on one of said connector blocks adjacent the mating surface thereof and another part on the other of said connector blocks adjacent the mating surface thereof.

10. A connector system as set forth in claim 9, wherein said dovetail prism-shape member includes said mating surfaces.

11. A connector system as set forth in claim 1, comprising plural cable means of coaxial type for high speed signal transmission, each cable means including at least one signal conductor for carrying high speed signals and shielding about said signal conductor for maintaining a reference potential relative to such signals, each said terminator means including respective contact means for terminating said signal conductor and shielding of the respective cable means, and said frame means including electrically conductive material maintainable at a reference potential to provide shielding around said contact means and the connections thereof to said signal conductors within said frame means.

12. A connector system as set forth in claim 1, wherein said frame means comprises a pair of linear rails and a pair of end blocks, and securing means for securing each end block to both said rails at respective end portions thereof.

* * * * *